United States Patent [19]

Pritchett et al.

[11] Patent Number: 4,617,807

[45] Date of Patent: Oct. 21, 1986

[54] INVOLUTE COIL COLD PLATE

[75] Inventors: James D. Pritchett, Plano; James D. Cutbush, San Antonio, both of Tex.

[73] Assignee: Booth, Inc., Dallas, Tex.

[21] Appl. No.: 752,556

[22] Filed: Jul. 8, 1985

[51] Int. Cl.[4] ..... B67D 5/62

[52] U.S. Cl. ..... 62/399; 62/400; 62/459

[58] Field of Search ..... 62/398, 399, 400, 459, 62/396; 222/146.6

[56] References Cited

U.S. PATENT DOCUMENTS

| | | | |
|---|---|---|---|
| 1,237,050 | 8/1917 | Kafer | 62/398 |
| 1,661,385 | 3/1928 | Pocock | 62/398 X |
| 1,782,720 | 11/1930 | Franklin | 62/398 X |
| 2,039,556 | 5/1936 | Ruse | 62/399 X |
| 3,011,323 | 12/1961 | Jaeger | 62/400 X |

*Primary Examiner*—Lloyd L. King

*Attorney, Agent, or Firm*—Richards, Harris, Medlock & Andrews

[57] ABSTRACT

An improved cold plate (10) is disclosed for use in cooling carbonated water and syrup which is mixed to form a beverage. The cooling coil (10) employs a plurality of involute carbonated water cooling coils (12–16) formed of tubing through which is flowed the carbonated water. The use of involute coils provides a more uniform thermal gradient within the cold plate (10) and resists bridging of the cooling medium, typically ice. The syrup cooling coils (18–28) can be constructed in either a serpentine or involute configuration.

10 Claims, 3 Drawing Figures

INVOLUTE COIL COLD PLATE

TECHNICAL FIELD

This invention relates to the beverage industry, and in particular to the cooling of beverage syrup and carbonated water prior to mixing and dispensing.

BACKGROUND ART

One of the most common techniques for dispensing carbonated beverages is to mix a relatively small quantity of concentrated beverage syrup with a relatively large quantity of carbonated water immediately prior to serving the beverage. The syrup and carbonated water are drawn from their respective containers through tubing into a cooler where the fluids are separately cooled. Failure to adequately cool the liquids is distressing to the consumer. After the fluids are separately cooled in the cooler, they are mixed at a tap for delivery to the container or glass provided to the consumer.

A commonly used cooler because of its simplicity and low cost is constructed of a thermally insulated box in which is placed flakes or cubes of ice. The ice rests on a cold plate provided at the bottom of the box. The cold plate is commonly formed of a cast aluminum block which encases a plurality of serpentine shaped coils. The coils are formed of tubing through which the syrup and carbonated water pass. Heat is conducted from the syrup and carbonated water passing through the coils, through the plate and to the ice. Because a much larger quantity of carbonated water relative to syrup is required for a typical beverage, there are usually at least three coils for cooling carbonated water for each coil carrying a syrup. However, a plurality of syrup cooling coils are usually provided so that a number of beverages can be served, with the carbonated water being used for all the beverages.

A severe problem with this type of cooler is the occurrence of "bridging" of the ice. The inlets for the syrup and carbonated water are all generally provided at one end of the cold plate and the outlets at the opposite end of the cold plate. This fact, coupled with the serpentine nature of the coils within the cold plate, provides for a significant thermal gradient in the cold plate. This thermal gradient causes the ice to melt faster near the inlet of the coils, melting the ice in contact with that particular area of the cold plate. The liquid is then drained from the cooler through a drain hole and the ice thus bridges over that portion of the cold plate, significantly diminishing the cooling of the syrup and carbonated water. A need therefore exists for a cooler which minimizes this bridging problem, yet remains economical.

SUMMARY OF THE INVENTION

In accordance with one aspect of the present invention, a cold plate is provided for cooling liquids. The cold plate includes at least one involute coil formed of tubing, the tubing having an inlet and an outlet for permitting a fluid to flow through the tubing. A thermally conductive material encases the coil for conducting thermal energy from the liquid in the coil to cool the liquid. The involute coil provides for relatively uniform heat transfer through the thermally conductive material.

In accordance with another aspect of the present invention, a plurality of involute coils are encased with the thermally conductive material. The inlet of the involute coils alternate between connection to the radially innermost turn of the coil and the radially outermost turn of the adjacent coil to provide for a more uniform heat transfer from the fluid passing through the coils through the thermally conductive material. Alternatively, the inlets can be all connected to the radially innermost turn of the coils and the outlets to the radially outermost turn of the coils or vice versa.

In accordance with yet another aspect of the present invention, a plurality of involute coils are employed with the plane of each of the coils parallel and spaced from the other coils. The inlet and outlet of each of the coils connected to the radially innermost turn of the coil are configured to extend from a single edge of the thermally conductive material in a common plane.

BRIEF DESCRIPTION OF THE DRAWINGS

A more complete understanding of the invention and its advantages will be apparent from the following Detailed Description when taken in conjunction with the accompanying Drawings, in which.

DETAILED DESCRIPTION

Figure 1A:
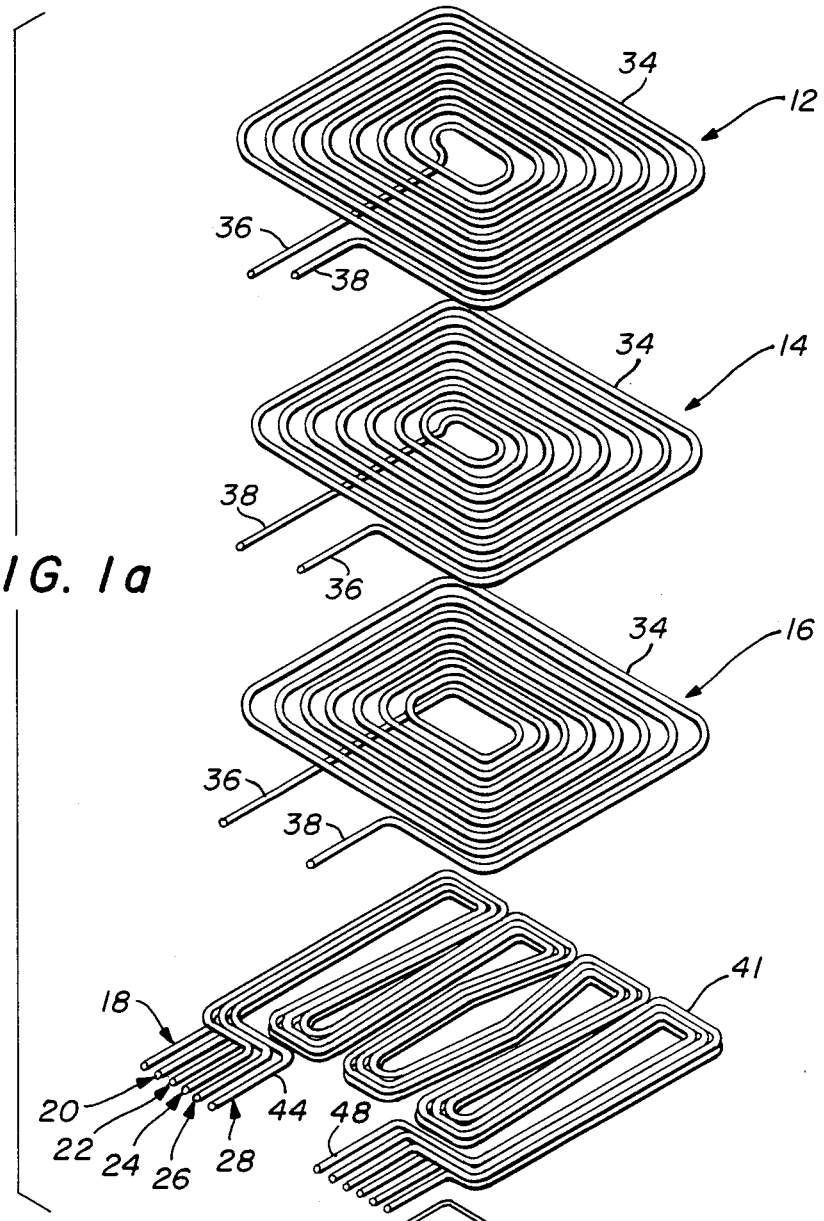
FIG. 1*a* is an exploded view of the cooling coils employed in a cold plate forming one embodiment of the present invention.
Figure 1B:
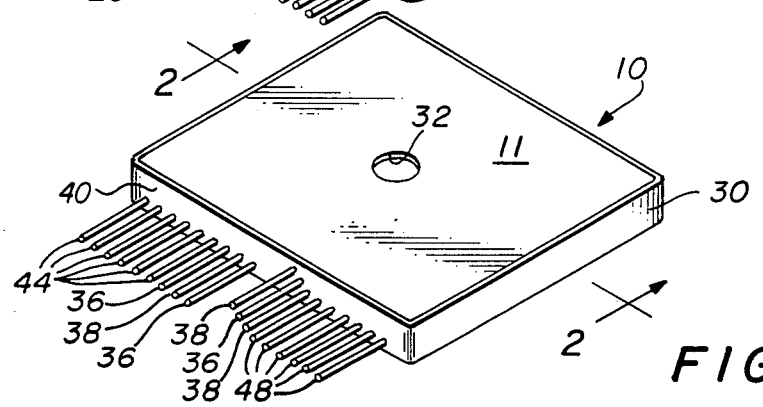
FIG. 1*b* is a perspective view of the cold plate.

Referring now to the Drawings, wherein like reference characters designate like or corresponding parts throughout several views, and in particular to FIG. 1*b*, a cold plate 10 forming an embodiment of the present invention is illustated.

The cold plate 10 is designed for placement within the bottom of a cooler. Ice is then put on the planar top surface 11 of the cold plate 10 to cool the beverage syrup and carbonated water passing through the cold plate 10 as will be described hereinafter. The cold plate 10 includes involute water coils 12, 14 and 16 and six syrup cooling coils 18–28, all of which are encased within a thermally conductive material 30. A drain hole 32 is provided through the cold plate 10 to drain liquified ice from the cooler.

It will be observed that each of the water cooling coils 12, 14 and 16 has an involute shape formed by bending the tubing 34 forming each of the coils into a generally spiral shape within a single plane. As is clear from FIG. 1*a*, each turn of the water cooling coils has gentle 90° bends to reduce friction losses in the flow of fluids through the coil.

Each of the water cooling coils 12–16 is provided with an inlet section 36 and an outlet section 38. As will be observed, the middle water cooling coil 14 has the inlet section 36 connected to the radially outermost turn of the coil while the water cooling coils 12 and 16 have the inlet section connected to the radially innermost turn of the coil. It is recommended that this alternating pattern be used as it causes the relatively warm inlet fluid to enter the cold plate 10 at different positions in the plate so that as the carbonated water is cooled, the temperature distribution through the cold plate 10 is more uniform to reduce the likelihood of bridging and also maximizes the cooling of the carbonated water. However, if desired, the inlet sections can all be connected to the radially innermost turns and the outlet sections to the radially outermost turns or vice versa.

Figure 2:
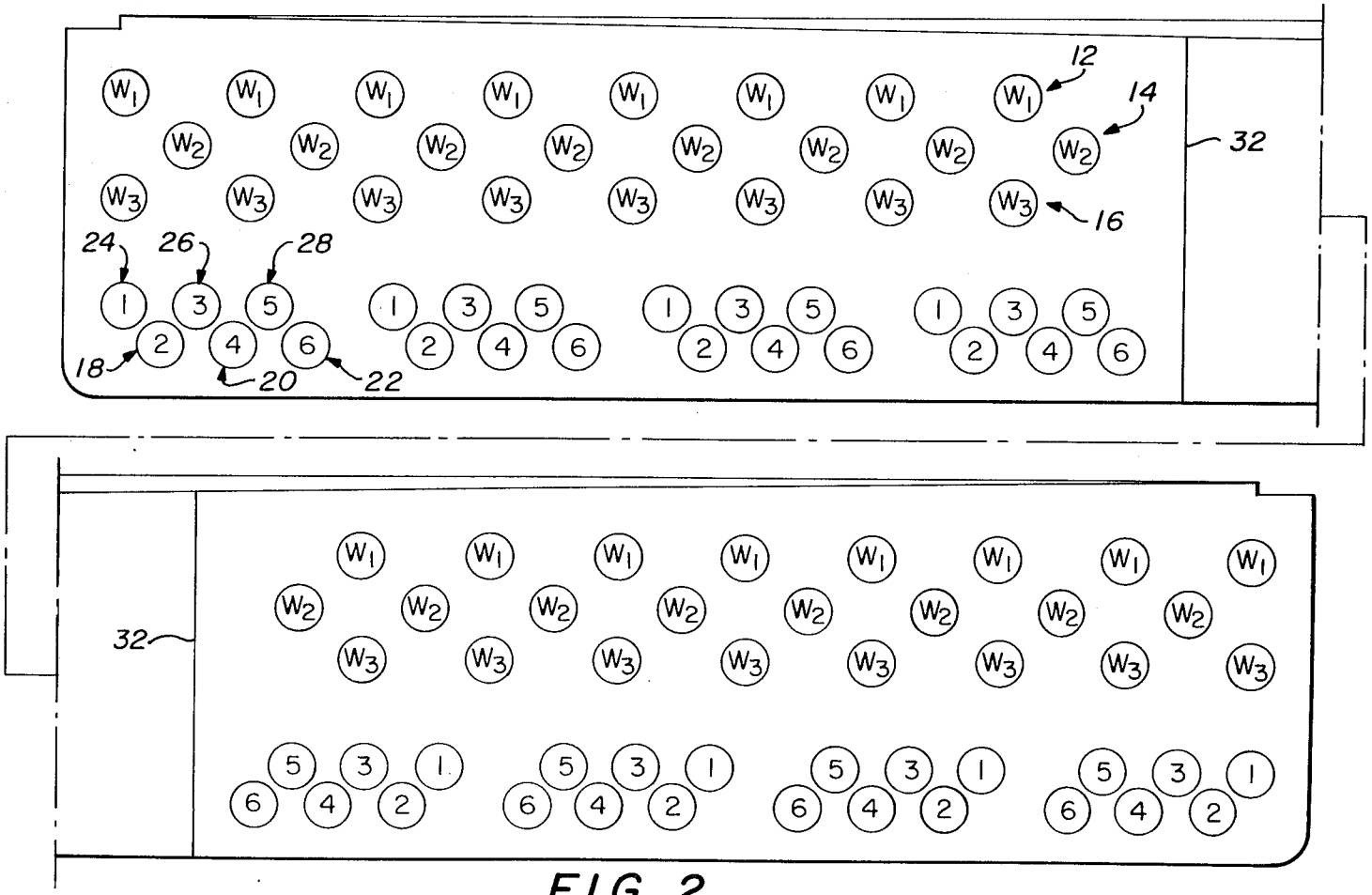
FIG. 2 is a cross section of the cold plate taken along line 2—2 in FIG. 1*b* illustrating the distribution of the turns of the cooling coils within the cold plate.

With reference to FIG. 2, it can be seen that the water cooling coils 12, 14 and 16 are spaced vertically in the cold plate 10 in a stacked arrangement. As the inlet sections 36 of coils 12 and 16 and the outlet section 38 of coil 14 must be bent out of the plane of the respective coil to avoid interference with the turns of the coil, these sections can as readily be bent to extend outwardly from edge 40 of the plate 10 in a common plane for connection to the supply of carbonated water or the mixing tap. In contrast, the outlet sections 38 of coils 12 and 16 and the inlet section 36 of coil 14 can simply be routed through edge 40 in the same plane as the coils, as best seen in FIG. 1*b*. However, each of the sections extending from the radially outermost turn of a particular water cooling coil can be bent to extend out of edge 40 in the same plane as all the other connections shown, or the sections extending from the radially innermost turn of a coil can be bent outside the radially outermost turn back into the plane of the coil so that the inlet and outlet are in a common plane with the coil, as desired.

The syrup cooling coils 18–28 are formed of tubing 41 bent in a generally serpentine configuration and all lie generally within a single plane, although in two separate layers to conserve space. As can best be seen in FIG. 1*a*, this serpentine configuration necessitates the use of a plurality of 180° bends, increasing the resistance to flow of the syrup within the coils. However, as a relatively small quantity of syrup is required relative to the carbonated water, the flow rate through the syrup coils is relatively low and these frictional losses are of little consequence. The inlet sections 44 of each syrup cooling coil are connected to a source of a particular beverage syrup. The use of six separate syrup cooling coils thus provides the flexibility of cooling six separate beverages, with the carbonated water being commonly used for all the beverages. The outlet sections 48 are connected to individual taps where a particular syrup and carbonated water are mixed. As can be seen, the inlet sections 44 and outlet sections 48 extend from the edge 40 of the material 30. If desired, the inlet and outlet sections 44 and 48 can be alternated along the edge 40 to provide even more uniform temperature gradients in the cold plate 10. However, due to the relatively low flow rates of the syrup, this would not have as much effect as alternating the inlet and outlets of the carbonated water as discussed previously.

In one cold plate constructed in accordance with the teachings of the present invention, the tubing 34 and 41 is constructed of 304 stainless steel. The thermally conductive material 30 is aluminum. The cold plate is constructed by positioning the coils in the desired orientation within a mold and pouring molten aluminum into the mold to encase the coils in the cold plate 10. The dimensions of the plate are 19"×21"×2 $\frac{5}{8}$" thick with the tubing having a 0.312 inch outer diameter with a 0.024 inch wall thickness. The tubing 34 forming each of the water cooling coils is approximately thirty-one feet long while the tubing 41 forming the individual syrup cooling coils is approximately twelve to eighteen feet long.

It will be understood that the configuration of the particular cold plate 10 provides significant advantages over the prior art designs in providing for more uniform heat transfer from the fluid within the coils to the cooling medium, in this case ice. This prevents bridging of the ice and ensures a more uniform cooling of the plate. The use of involute water cooling coils also increases the surface area of the tubing in contact with the thermally conductive material 30 to more effectively cool the carbonated water. The elimination of sharp 180° bends also reduces the pressure drop in the involute water cooling coils. The involute water cooling coils are also more efficient and less expensive to manufacture than the prior serpentine coils. The advantages of using involute coils for cooling the carbonated water also allows a minimization of the number of water cooling coils required and therefore results in a thinner plate, thereby even further increasing the efficiency of cooling and decreasing manufacturing costs in eliminating material requirements.

In a modification of cold plate 10, pre-mixed syrup and carbonated water can be provided to the inlet sections 36 of the involute coils 12, 14 and 16. The uniform heat transfer from the coils 12, 14 and 16 will effectively cool the carbonated beverage flowing through the coils. In this modification, the syrup cooling coils 18–28 can be eliminated. If desired, additional involute coils can be stacked in cold plate 10 to provide adequate cooling for the beverages cooled. For example, a given beverage may be cooled in one or more of the involute coils, and the number of different beverages cooled will be limited only by the number of involute coils used.

Although one embodiment of the present invention has been illustrated in the accompanying Drawings and described in the foregoing Detailed Description, it will be understood that the invention is not limited to the embodiment disclosed, but is capable of numerous rearrangements, modifications and substitutions of parts and element without departing from the scope and spirit of the invention.

What is claimed is:

1. A cold plate for cooling liquids, comprising:

a plurality of involute coils formed of tubing, the tubing of each coil having an inlet and an outlet for permitting a liquid to flow through the tubing, each of said involute coils lying in a horizontal plane with the involute coils being stacked vertically with a space between each adjacent coil; and a thermally conductive material encasing the coils for conducting thermal energy from the liquid in the coils to cool the liquid, the thermally conductive material having an upper surface being generally horizontal for contact with ice to cool the liquids within the involute coils, the involute coils providing for relatively uniform heat transfer through the thermally conductive material.

2. The cold plate of claim 1 having the portion of the tubing extending from the radially innermost turn of the coil for each of the coils being configured to extend from a single edge of the thermally conductive material in a common plane.

3. A cold plate for cooling syrup and carbonated water prior to mixing and dispensing, comprising:

a plurality of involute coils formed of tubing, each of said coils lying in a horizontal plane with the coils being stacked vertically with a space between each adjacent coil the tubing of each coil having an inlet and an outlet for permitting carbonated water to flow through the tubing;

at least one syrup coil formed of tubing, the tubing having an inlet and outlet for permitting a syrup to flow through the tubing; and a thermally conductive material encasing the involute coils and syrup coil for conducting thermal energy from the liquid in the coils to cool the liquids, the involute coils providing for relatively uniform heat transfer from the carbonated water being cooled through the thermally conductive material.

4. The cold plate of claim 3 wherein the thermally conductive material defines an upper surface for contact with a cooling medium and an edge, each of the involute coils being stacked vertically with the plane of the coil being generally parallel the upper surface of the thermally conductive material, the plane of the syrup coil also being generally parallel the plane of the involute coils and the upper surface and lying beneath the involute coils.

5. The cold plate of claim 3 wherein each of the inlets and outlets connected to the radially innermost turn of the involute coils are configured to avoid interference with the coils and extend from the thermally conductive material in a common plane.

6. A cold plate for cooling carbonated water and syrup for mixing to form a beverage, comprising:

a plurality of involute coils, each of said coils lying in a horizontal plane, formed of tubing, the tubing having an inlet and an outlet for permitting carbonated water to flow through each of the involute coils;

at least one serpentine syrup coil formed of tubing, the tubing having an inlet and an outlet for permitting a syrup to flow through the tubing; and a thermally conductive material encasing the coils with the planes of the coils being parallel and stacked vertically with the involute coils above the serpentine coil, the thermally conductive material defining an upper surface generally parallel with the planes of the coils and an edge, the inlet to the involute coils being alternately connected to the radially innermost turn of the coil and the radially outermost turn of the coil in the vertical direction to insure more uniform heat transfer through the thermally conductive material, the inlets and outlets of the involute coils being connected to the radially innermost turn of an involute coil being configured to avoid interference with the coil and pass through the edge of the thermally conductive material in a common plane with the inlet and outlet of the serpentine coil.

7. The method of cooling syrup and carbonated water in a cold plate comprising the steps of:

passing the carbonated water through a plurality of involute coils, each of said involute coils lying in a horizontal plane with the involute coils being stacked vertically with a space between each adjacent involute coil, each coil having tubing with an inlet and an outlet, the involute coils being encased within a thermally conductive material in contact with a cooling medium, the flow of heat from the carbonated water thereby being uniform through the thermally conductive material to resist bridging of the cooling medium;

passing syrup through tubing formed into a coil encased within the thermally conductive material to cool the syrup; and cooling the carbonated water and syrup by placing a cooling medium in thermal communication with the thermally conductive material.

8. The method of claim 7 further comprising the step of passing carbonated water through the plurality of involute coils within the thermally conductive material in opposite directions to provide for a more uniform thermal gradient through the thermally conductive material and more effective cooling of the carbonated water.

9. The method of cooling pre-mixed syrup and carbonated water forming a carbonated beverage in a cold plate comprising the steps of:

passing the carbonated beverage through a plurality of involute coils, each coil lying in a horizontal plane and being formed of tubing having an inlet and an outlet, the coils being stacked vertically with a space between adjacent coils, the involute coils being encased within a thermally conductive material in contact with ice, the flow of heat from the carbonated beverage thereby being uniform through the thermally conductive material to resist bridging of the ice; and cooling the carbonated beverage by placing ice in thermal communication with the thermally conductive material.

10. The method of claim 9 further comprising the step of passing carbonated beverages through the plurality of involute coils within a thermally conductive material in opposite directions to provide for a more uniform thermal gradient through the thermally conductive material and more effective cooling of the carbonated beverages.

* * * * *